US006138624A

United States Patent [19]

Wolck et al.

[11] Patent Number: 6,138,624

[45] Date of Patent: Oct. 31, 2000

[54] TAPPET SOCKET ASSEMBLY FOR ROCKER LEVER ASSEMBLY AND METHOD OF ASSEMBLING THE SAME

[75] Inventors: John G. Wolck, Lakewood; Mark B. Hinderleider, Jamestown; Steve G. Leiby, Lakewood; Anthony D. Greszler, Jamestown, all of N.Y.; Mike S. Hagadorn, Russell, Pa.

[73] Assignee: Cummins Engine Company, Inc., Columbus, Ind.

[21] Appl. No.: 09/259,944

[22] Filed: Mar. 1, 1999

[51] Int. Cl.[7] ..... F01L 1/18

[52] U.S. Cl. ..... 123/90.39; 123/90.36; 74/519; 74/559; 29/888.2

[58] Field of Search ..... 123/90.39, 90.4, 123/90.41, 90.42, 90.43, 90.44, 90.33, 90.36; 74/519, 559; 29/888.2

[56] References Cited

U.S. PATENT DOCUMENTS

| | | | |
|---|---|---|---|
| 1,504,496 | 8/1924 | Peck . | |
| 1,515,201 | 11/1924 | Hewitt . | |
| 1,521,623 | 1/1925 | Hendrickson . | |
| 1,699,657 | 1/1929 | Fagan . | |
| 1,958,264 | 5/1934 | Chilton . | |
| 2,322,172 | 6/1943 | Spencer | 184/6.9 |
| 2,448,989 | 9/1948 | Leake | 74/519 |
| 3,016,887 | 1/1962 | Streit et al. . | |
| 3,166,058 | 1/1965 | Zink | 123/90.27 |
| 3,556,061 | 1/1971 | Schmidt et al. | 123/90.27 |
| 4,815,424 | 3/1989 | Buuck et al. | 123/90.46 |
| 4,856,468 | 8/1989 | Speil et al. | 123/90.47 |
| 4,905,577 | 3/1990 | Schneeweiss . | |
| 5,632,237 | 5/1997 | Cornell et al. | 123/90.46 |
| 5,636,600 | 6/1997 | Sweetland et al. . | |
| 5,680,838 | 10/1997 | See et al. | 123/90.46 |
| 5,706,771 | 1/1998 | Heyningen et al. | 123/90.46 |
| 5,722,227 | 3/1998 | Stahlecker . | |
| 5,890,463 | 4/1999 | Speil | 123/90.46 |

*Primary Examiner*—Weilun Lo
*Attorney, Agent, or Firm*—Leydig, Voit & Mayer, Ltd.

[57] ABSTRACT

A tappet socket assembly for a rocker lever assembly or other lever assembly includes a retainer, a tappet socket, and a ball bearing. The rocker lever is adapted to be rocked about a pivot axis and includes a cylindrical opening or bore which partially receives the ball bearing. The retainer includes a cage provided by a plurality of legs and a cylindrical side wall insert. The side wall is secured within the cylindrical bore and press fitted therein by the ball bearing. The ball bearing exerts radially outward force on the retainer to secure the ball bearing and retainer to the rocker lever. The tappet socket includes a spherical concave recess that closely receives the ball bearing to provide a ball and socket joint and a flat engaging face for transferring the force of the rocker lever to a valve crosshead. The tappet socket is retained in the cage between the legs.

25 Claims, 6 Drawing Sheets

TAPPET SOCKET ASSEMBLY FOR ROCKER LEVER ASSEMBLY AND METHOD OF ASSEMBLING THE SAME

FIELD OF THE INVENTION

The present invention relates generally to lever assemblies and more particularly to tappet socket assemblies for lever assemblies in internal combustion engines.

BACKGROUND OF THE INVENTION

Rocker lever assemblies are used in internal combustion engines to control the opening and closing of intake and exhaust valves. An example of such a rocker lever system is generally disclosed in U.S. Pat. No. 5,636,600, assigned to Cummins Engine company, Inc. Rocker lever assemblies typically include a rocker lever with first and second lever arms that are pivotable about a pivot axis. The end of the lever arm engages the valve cross head of one or more intake or exhaust valves. During the downward pivoting movement of the lever arm, the lever arm pushes the valve crosshead and therefore the valve linearly downward to open the valve. During upward pivoting movement of the lever arm, a spring urges the crosshead upward against the lever arm to close the valve.

Translating the partial rotary path of the rocker lever into linear reciprocation of the valves causes a transverse sliding movement between the valve crosshead and the end of the lever arm. Accordingly, a tappet assembly, also commonly known as an "elephant's foot", is employed to drivingly connect the lever arm to the valve crosshead to facilitate reciprocating linear movement of the valve while allowing for transverse sliding movement between the valve crosshead and the end portion of the lever arm. Various attempts at tappet assemblies or other related ball and socket joints for rocker lever assemblies and other lever assemblies are generally disclosed in U.S. Pat. Nos. 1,958,264, 1,699,657, 1,504,496, 1,521,623, 1,515,201, 3,016,887, 4,905,577.

A common way of providing a tappet assembly has been to provide a threaded screw shaft having a hemispherical ball end in combination with a tappet socket. The tappet socket typically includes spherical recess receiving the ball end and a flat engaging face for engaging a corresponding flat face of the valve crosshead. From a standpoint of initial assembly of the rocker lever assembly, and disassembly and reassembly of the rocker lever assembly for repairs, it is highly desirable that the tappet socket, which is typically relatively small, be retained to a larger component to prevent the tappet socket from falling out or becoming misplaced. It is also a requirement in some applications that the tappet assembly must provide enough room to set the lash in the system.

Attempts to retain the tappet socket include connecting the tappet socket to the threaded fastener (that has a ball-end) with a flexible connector or deforming an outer edge of the socket around the ball end of the fastener. However, these attempts are economically disadvantageous from both a parts cost and an assembly/manufacturing cost. Some of these prior attempts have also had reliability drawbacks or used undesirably excessive space.

SUMMARY OF THE INVENTION

It is therefore a main objective of the present invention to provide a less expensive way to pivotably connect a tappet socket to a lever arm while providing for retention of the tappet socket on the lever arm.

In achieving this objective, it is a further object to provide a tappet socket assembly that is highly reliable, more compact and which allows the lash in the system to be set.

Accordingly, the present invention is directed towards a lever assembly which includes a lever arm, a retainer, a socket, and a bearing. The lever arm has an opening and is pivotable about a pivot axis. The retainer includes an insert portion securely mounted in the opening and a cage portion for retaining the socket therein. The insert portion includes a cavity that partially receives the bearing such that the bearing includes an exposed portion outside the cavity. The exposed portion of the bearing includes a convex face. The socket includes a recess which receives the convex face and an engaging face for transferring the force of the lever.

According to an embodiment, the present invention includes a rocker lever assembly for reciprocating a valve assembly. The valve assembly includes a valve crosshead which contacts the rocker lever assembly along a flat engaging surface and is biased against the rocker lever assembly under the action of a spring. The rocker lever assembly includes a rocker lever, a retainer, a tappet socket and a ball bearing. The rocker lever includes two arms for pivoting movement about a pivot axis. At least one of the arms includes a cylindrical bore. The retainer includes a cylindrical side wall and a plurality of legs to provide a cage. The side wall is secured in the cylindrical bore and the legs project outward from the bore. The legs include a radial outward segment projecting radially outward from the cylindrical side wall, an end segment projecting radially inward and an intermediate portion disposed axially therebetween. The tappet socket includes a spherical recess that closely receives the ball bearing and a flat engaging face for contacting the flat surface of the crosshead. The tappet socket is retained between the legs of the retainer and has an outer rim disposed between the outward and inward projecting portions of the legs. The rim has an outer diameter that is greater than the distance between the legs to thereby provide for retention of the tappet socket. The ball bearing is press fitted into the side wall and exerts radially outward force on the side wall and against the inner surface of the cylindrical bore to secure the tappet socket assembly into the rocker lever assembly.

According to another aspect of the present invention, a tappet assembly is provided for assembling into a lever assembly that includes an arm with an opening pivotable about a pivot axis. The tappet assembly includes a retainer, a ball bearing, and a tappet socket. The retainer includes an outer side wall and a cage. The outer side wall is adapted to be slidably received in the opening. The ball bearing is sized to be closely received within the outer side wall and is adapted to exert radially outward force on the side wall for press fitting the retainer in the opening. More specifically, the diameter of the ball bearing combined with the thickness of the side wall is greater than the diameter of the inner surface of the opening in the lever. The tappet socket includes an engaging face and a recess for receiving the ball bearing. The tappet socket is dimensioned to be manipulated into the cage and retained therein for assembly purposes.

According to another aspect of the present invention, a method of assembling a rocker lever assembly is provided. The method comprises providing a rocker lever, a retainer, a ball bearing, and a tappet socket. The rocker lever includes a lever arm pivotable about a pivot axis and defines a cylindrical opening. The retainer includes a side wall and a cage. The tappet socket includes a spherical recess and engaging face. The method further comprises inserting the retainer into the cylindrical opening with the side wall being closely received therein. Then the ball bearing is press fitted into the inserted retainer to secure the ball bearing and the retainer in the opening. Lastly, the tappet socket is manipulated into the cage for retention thereby with the recess receiving the ball bearing.

These and other aims, objectives, and features of the invention will become more apparent from the following detailed description when taken in conjunction with the accompanying drawings.

Figure 1:
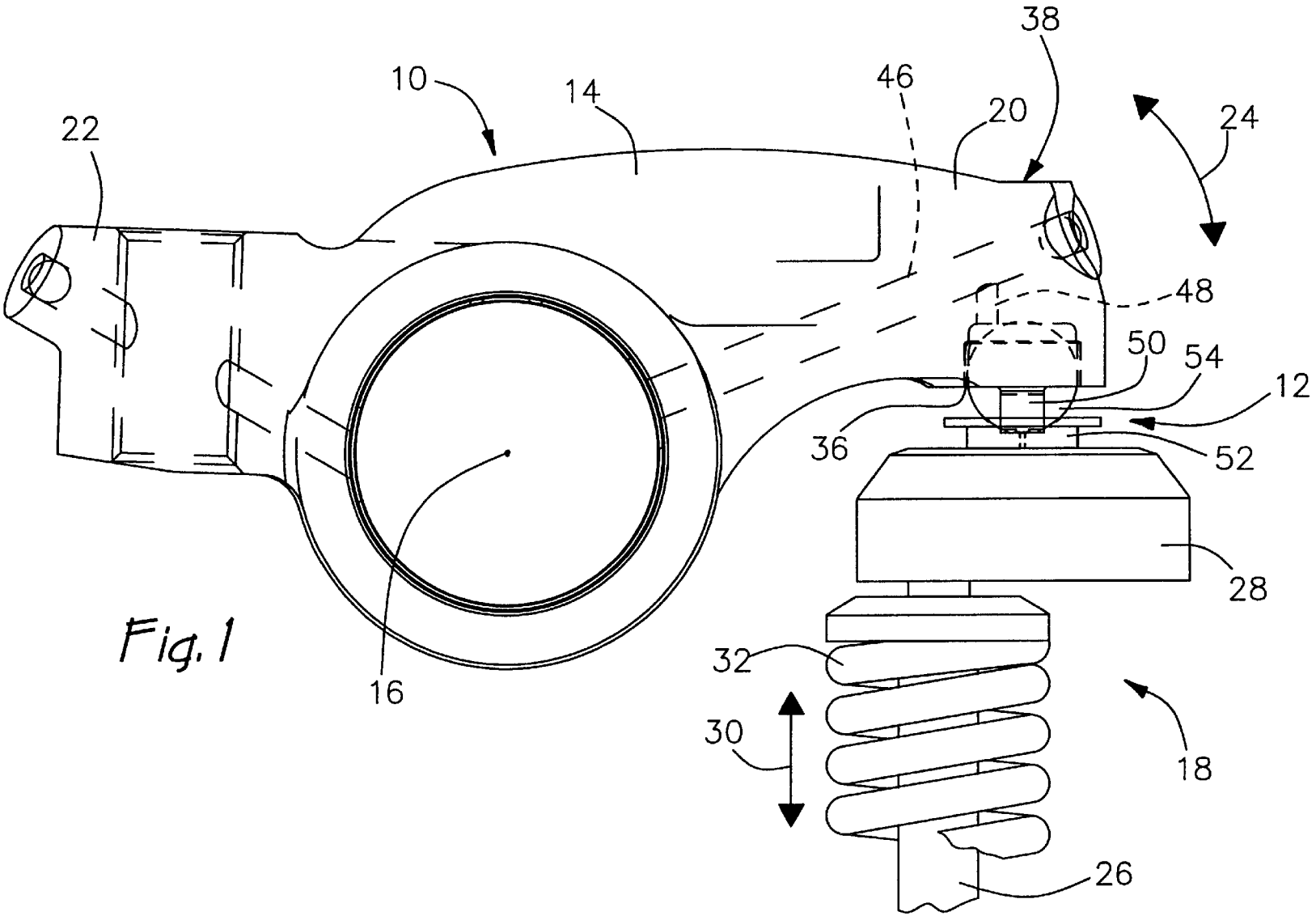
FIG. 1 is a front elevational view of a rocker assembly installed in association with a valve assembly, according to a preferred embodiment of the present invention.

While the invention is susceptible of various modifications and alternative constructions, certain illustrative embodiments thereof have been shown in the drawings and will be described below in detail. It should be understood, however, that there is no intention to limit the invention to the specific forms disclosed, but on the contrary, the intention is to cover all modifications, alternative constructions and equivalents falling within the spirit and scope of the invention as defined by the appended claims.

DETAILED DESCRIPTION OF THE PREFERRED EMBODIMENT

Referring to FIG. 1, a rocker lever assembly 10 including a tappet socket assembly 12 is shown in accordance with a preferred embodiment of the present invention. The rocker lever assembly 10 includes a rocker lever 14 that is pivotable about a pivot axis 16 for actuating a valve assembly generally designated at 18. The rocker lever 14 includes first and second lever arms 20, 22 that extend outward in opposing directions from the pivot axis 16 for actuating intake and exhaust valves of an internal combustion engine. The rocker lever 14 is adapted to rock about its pivot axis 16 along a partially radial or arc shaped path 24 to reciprocate the lever arms 20, 22.

The exemplary valve assembly 18 includes a valve stem 26 having a valve crosshead 28 at one end and a valve (not shown) at the other end. The valve stem 26 is adapted to be reciprocated in a generally linearly manner as indicated by linear path 30. A spring 32 disposed generally concentrically over the valve stem 26 engages the crosshead 28 and biases the valve assembly 18 against the rocker lever assembly 10. Further details of an exemplary valve assembly may be seen with reference to U.S. Pat. No. 5,636,600.

Referring in greater detail to the rocker lever assembly 10, a tappet socket assembly 12, a known tappet socket assembly 15 sometimes referred to as an "elephant's foot" to those familiar with the art, is secured in an opening 36 in the first arm 20 near the outer end 38 of the arm 20. Referring to the embodiment of the invention in FIG. 3, the opening 36 is generally provided by at least one and preferably a pair of bores 40, 42 including a deeper smaller diameter bore 40 and a larger diameter counter bore 42. The smaller and larger diameter bores 40, 42 are connected by a generally radially planar seating surface 44. A lubricating passageway 46 extends through the lever arm 20 and connects with the opening 36 through an outlet port 48. The lubricating passageway 46 is adapted to receive and transport a small amount of lubricating fluid to the tappet assembly 34 through the outlet port 48.

Figure 9:
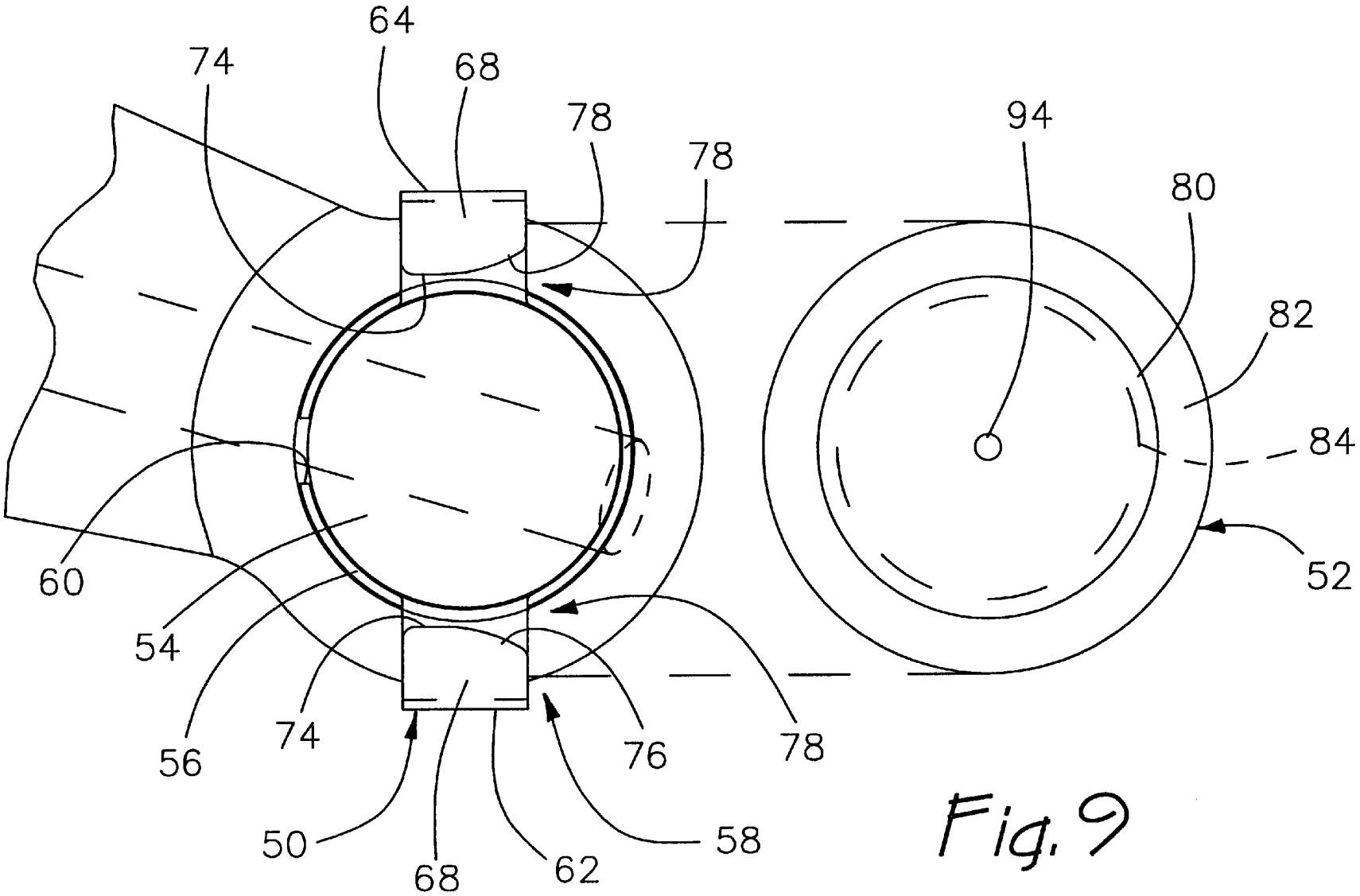
FIG. 9 is a fragmentary bottom view of the assembly of FIG. 1 illustrated with the tappet socket in a unsnapped condition.

The tappet socket assembly 12 generally includes a retainer 50, a socket 52 and a ball bearing 54. Referring to FIGS. 3–6, the retainer 50 includes a cylindrical insert or outer side wall 56 and a cage 58. The outer side wall 56 is dimensioned to be closely received in the counter bore 42 and includes an axially extending slit 60 which provides some flexibility to side wall 56 allowing it to resiliently flex inward and outward. The outer diameter of the outer side wall 56 in the relaxed state may be about the same or slightly larger than the outer diameter of counter bore 42, but flexing the side wall 56 inward provides a diameter to the side wall 56 which is slightly smaller than the diameter of the counter bore 56, which facilitates relatively easy insertion of the retainer 50. The cage 58 is dimensioned to generally receive and retain the socket 52 and includes first and second legs 62, 64, which have some limited resilient flexibility. Each leg 62, 64 includes a radially outward extending segment 66 and a radially inward extending end segment 68 connected by an intermediate axially extending segment 70. Each end segment 68 has an outer edge 74 with an outwardly extending beveled or curved recess 76. The recesses 76 of the opposing legs 62, 64 generally face one another to provide a larger width separation 78 (FIG. 9).

Figure 3:
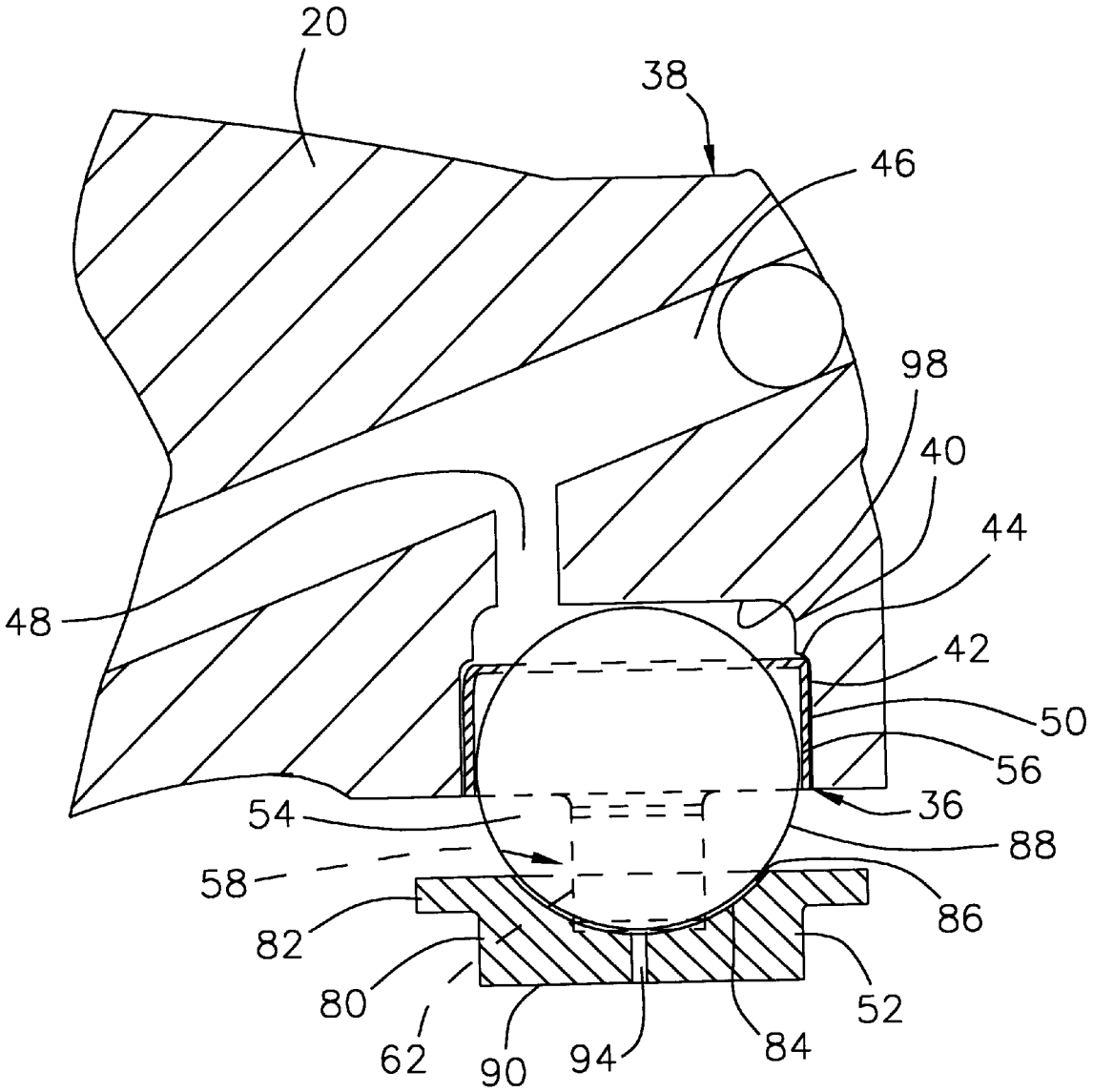
FIG. 3 is a cross-sectional and fragmentary view as taken generally along line 3—3 of FIG. 2.
Figure 6:
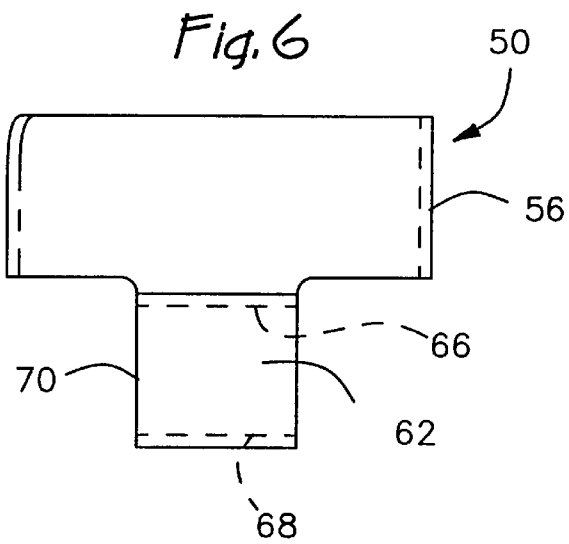
FIG. 6 is a side view of the retainer of FIG. 4.
Figure 4:
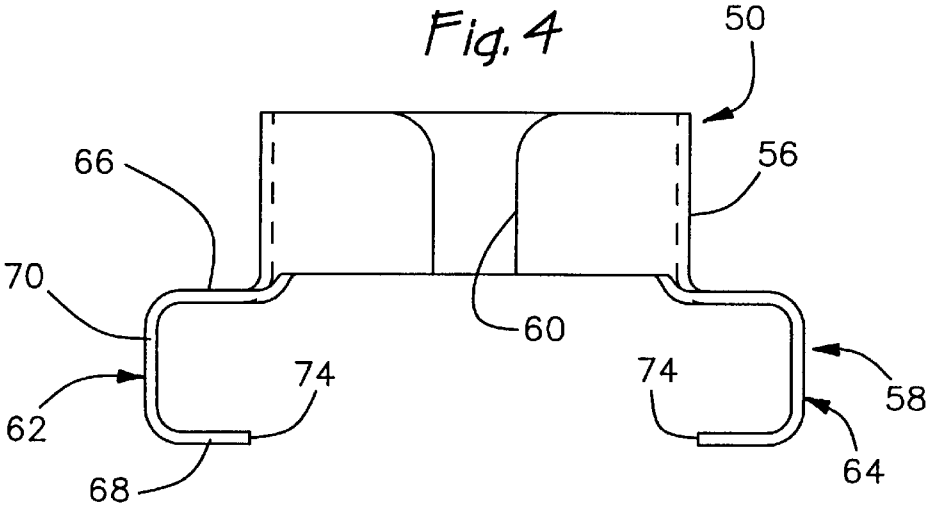
FIG. 4 is a front elevational view of a retainer for use in the rocker lever assembly of FIG. 1.
Figure 5:
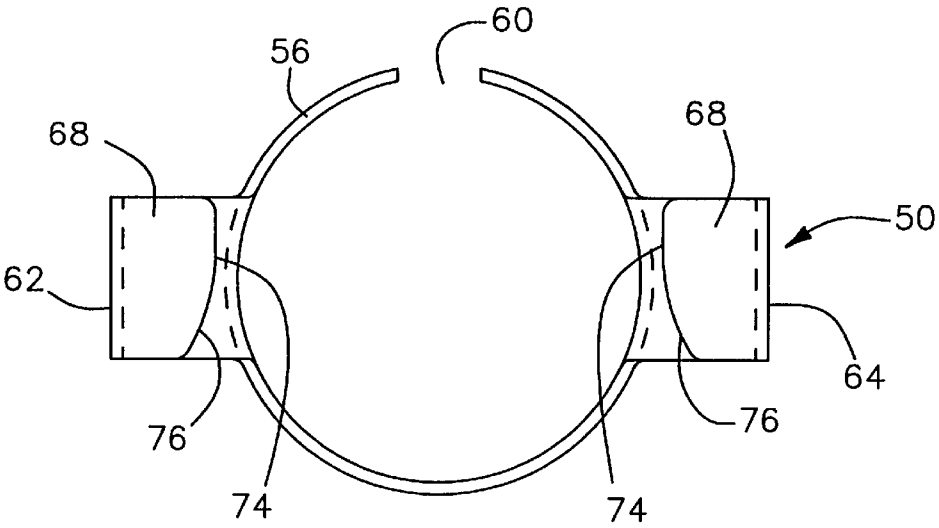
FIG. 5 is a bottom view of the retainer of FIG. 4.
Figure 8:
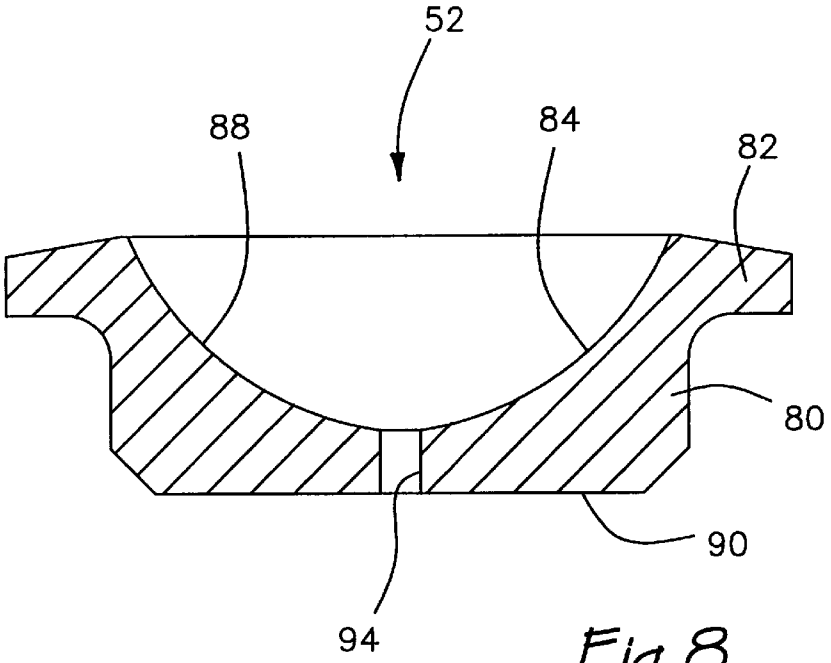
FIG. 8 is a cross-sectional view as taken generally along line 8—8 of FIG. 7.
Figure 7:
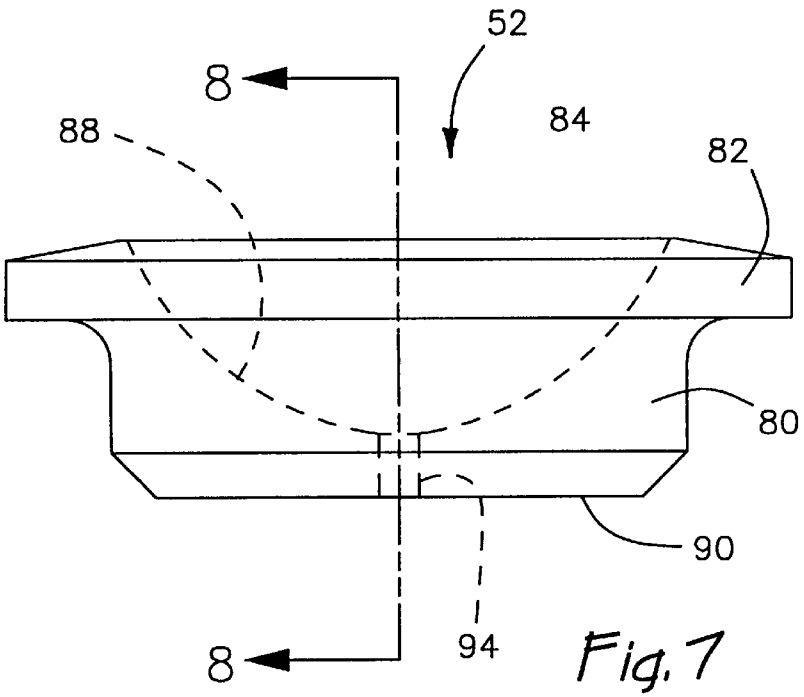
FIG. 7 is a side view of a socket used in the rocker lever assembly of FIG. 1.

Referring to FIGS. 3, 7 and 8, the socket 52 includes a generally cylindrically body 80 having a radially outward projecting annular rim 82. The cylindrical body 80 defines a recess 84 for closely receiving the bearing 54. The recess 84 provides a spherically concave surface 86 that is dimensioned to closely receive a corresponding spherical outer surface 88 of the ball bearing 54. The socket 52 also includes a generally planar engaging face 90 for contacting the valve assembly 18, and more specifically for contacting a corresponding planar engaging face 92 of the valve crosshead 28. The socket 52 includes a small through hole 94 disposed generally at the apex of the concave surface 86 that fluidically connects the recess 84 to the engaging face 90.

To assemble the tappet assembly 12 into the rocker lever assembly 10, the retainer 50 is closely inserted into the opening 36 and more specifically into the counter bore 42. The outer annular edge of the side wall 56 engages the seating surface 44 to stop insertion and align the retainer 50 generally concentric with the counter bore 42. Then, the ball bearing 54 is press fitted up into the retainer 50 to exert radially outward force on the side wall 56 against the inner surface of the counter bore 42, thereby securing the retainer 50 and the ball bearing 54 to the rocker lever 14. The force applied during press fitting operation is preferably at least about one and one half times as great as the maximum anticipated force that will be exerted by the rocker lever assembly 10 and valve assembly 18 during engine operation so that the position of the ball bearing 54 relative to the rocker lever 14 is fixed to maintain the desired accuracy and control over the valve assembly 18. As shown in the FIG. 3, the ball bearing 54 may contact the bottom 98 of the opening 36 after press fitting operation. To finish assembly, the tappet socket 52 is manipulated into the cage 58 and substantially locked therein. More specifically and referring to FIG. 9, the tappet socket 52 is inserted laterally from the side of the legs 62, 64 into the larger width separation 78 between the leg recesses 76 with the recess 84 being partially received by the ball bearing 54, and then a small axially force snaps the rim 82 past the legs 62, 64. The tappet socket 52 is thereby pivotably secured to the rocker lever 14 to provide a ball and socket joint. If necessary, the tappet socket 52 may be removed by snapping it out from the legs 62, 64.

Figure 2:
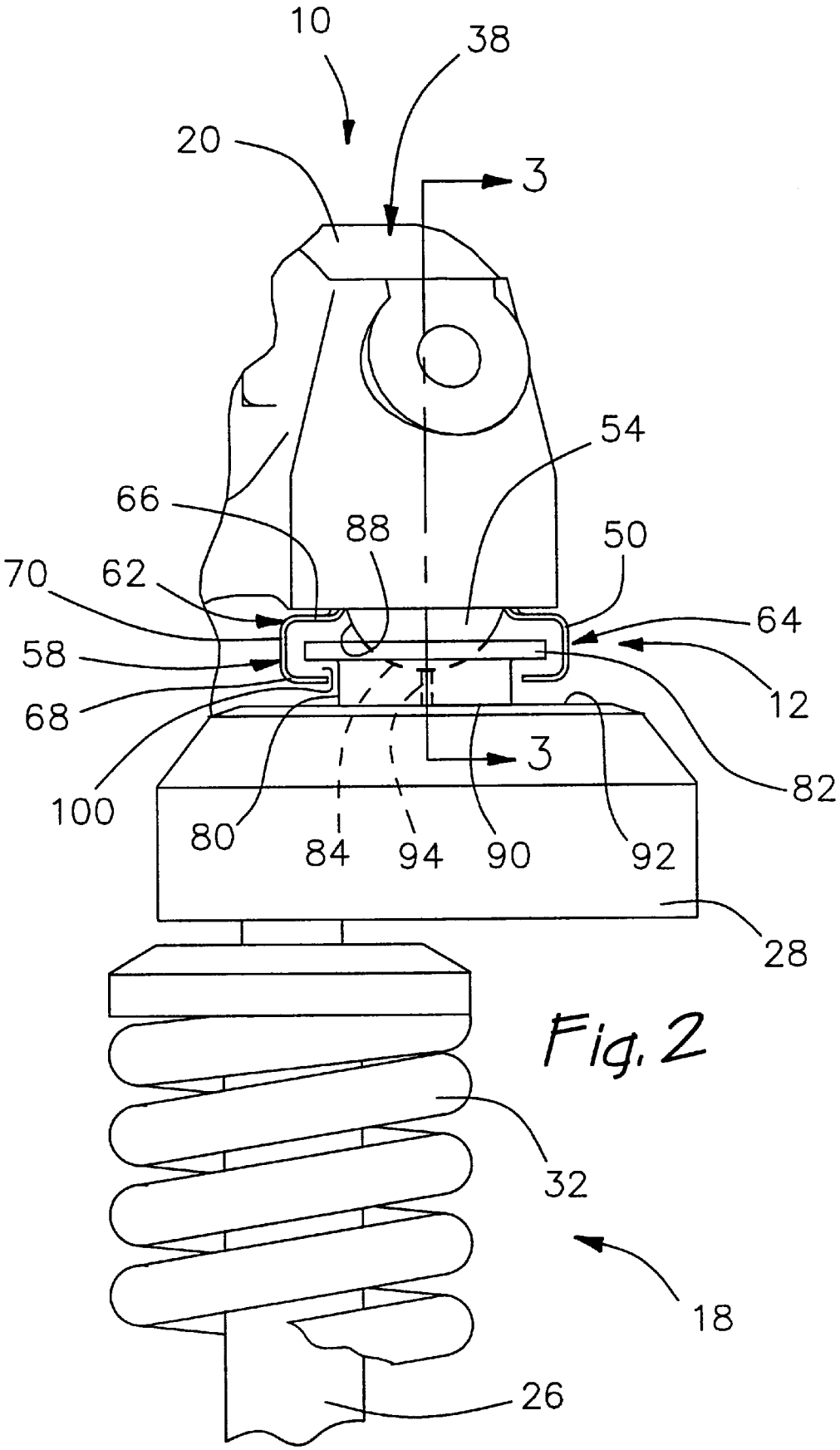
FIG. 2 is and end elevational view of FIG. 1.

Once the tappet assembly 52 is secured to the rocker lever assembly 10, the rocker lever assembly 10 may then be installed in association with the valve assembly 18. Once installed, the spring 32 urges the valve crosshead 28 against the tappet socket 52. The engaging faces 90, 92 of the tappet socket 52 and valve crosshead 28 are in contact to transfer linear force therebetween while allowing for transverse sliding movement therebetween. A small amount of lubricating fluid may lubricate the traverse sliding movement between engaging faces 90, 92 by flowing through the passageway 46 over the ball bearing 54, down through the axial slit 60, which also acts as a fluid passage, into the recess 84 and through the through-hole 94. During operation, the rocker lever 14 will rock or pivot about its pivot axis 16 to linearly reciprocate the valve assembly 18. During the cyclical rocking action of the rocker lever 14, the tappet socket 52 will engage ball bearing 54 and pivot with respect thereto without contacting the retainer 50, thereby providing a longer life span to the tappet assembly 12 and higher reliability. To ensure that the tappet socket 52 does not contact the retainer 50, a small gap 100 (FIG. 2) of selected size is provided between the retainer 50 and the tappet socket 52.

There are several advantages of the present invention. One advantage is that the present embodiment facilitates a relatively simple assembly with relatively inexpensive parts. The present invention also requires little space thereby saving valuable space that is often needed in engines. The present invention also achieves a substantial locking of the tappet socket to a larger part, the rocker lever, thereby preventing the tappet socket from falling out or becoming misplaced during assembly and repair. The tappet assembly also allows the lash in the system to be set if necessary.

Although a preferred embodiment is shown for particular application to rocker lever assemblies for automobiles, the present invention may also be used or adapted for other lever assemblies where a single lever arm is pivotable about a pivot axis for translating a movable member linearly or in a substantially linear fashion, or where a ball and socket joint is needed. Other dimensions and shapes are also possible for the bearing, the retainer and socket. Certain broader claims appended hereto are meant to include these broader applications.

All of the references cited herein, including patents, patent applications and publications are hereby incorporated in their entireties by reference. While this invention has been described with an emphasis upon preferred embodiments, it will be obvious to those of ordinary skill in the art that variations of the preferred embodiments may be used and that it is intended that the invention may be practiced otherwise than as specifically described herein. Accordingly, this invention includes all modifications encompassed within the spirit and the scope of the invention as defined by the following claims.

What is claimed is:

1. A lever assembly, comprising:

a lever arm defining a retainer opening;

a retainer having an insert portion forming a cavity, the insert portion being securely mounted in the retainer opening, and a cage extending from the insert portion;

a bearing partially received in the cavity such that an exposed portion of the bearing resides outside the cavity, the exposed portion including a convex engaging face; and a socket defining a concave recess and an engaging face for transferring the force of the lever assembly, the socket retained in the cage with the concave recess aligned to receive the convex engaging face of the bearing to allow for pivoting movement therebetween.

2. The lever assembly according to claim 1, wherein the insert portion of the retainer is generally cylindrical.

3. The lever assembly according to claim 2, wherein the insert portion is radially expandable.

4. The lever assembly according to claim 3 wherein the cavity in the insert portion has an inner diameter that is slightly smaller than an outer diameter of the bearing, so that the bearing, retainer and opening are secured together with a resistance fit.

5. The lever assembly of claim 2 wherein the insert portion has an axial slit.

6. The lever assembly of claim 5, wherein the lever arm is part of a rocker lever pivotable about a pivot axis for an internal combustion engine.

7. The lever assembly of claim 6 wherein the lever arm includes a lubricating passageway communicating with the opening for lubricating the bearing.

8. The lever assembly of claim 7 wherein the socket includes a passage therein connecting the recess and the engaging face, wherein lubricating fluid is adapted to flow through the lubricating passageway across the bearing through the axial split and through the passage for lubricating the engaging face.

9. The lever assembly of claim 1 further comprising a valve assembly including a linearly translatable valve stem, a valve crosshead and a spring, the spring urging the crosshead against the engaging face of the socket which in turn seats the recess of the socket against the outer peripheral surface of the bearing, the socket being freely disposed in the cage not contacting the cage for an operating range of movement of the lever about a pivot axis.

10. A rocker lever assembly for engaging a crosshead of a valve assembly, the crosshead being biased by a spring towards the rocker lever assembly and having a flat surface, the rocker lever assembly comprising:

a rocker lever having a pivot axis, the rocker lever having first and second arms, at least one of the arms having a cylindrical bore;

a retainer having a plurality of legs and a cylindrical side wall, the side wall being secured in the cylindrical bore, the legs including a radial outward segment projecting radially outward from the cylindrical side wall, an end segment projecting radially inward, and an intermediate segment disposed axially therebetween;

a tappet socket having a spherical recess and a flat engaging face for transferring the force of the rocker lever to the flat surface of the crosshead, the tappet socket interposed between the legs, having an outer rim disposed between the radial outward segment and the end segment, the rim having an outer diameter that is greater than the distance between the end segments of the legs; and a ball bearing press fitted into the retainer, disposed between the spherical recess and the first lever arm, exerting radial outward force on the side wall.

11. The rocker lever assembly of claim 10 wherein the side wall has an axially extending slit.

12. The rocker lever assembly of claim 11 wherein the first lever arm includes a lubricating passageway communicating with the bore for lubricating the ball bearing.

13. The rocker lever assembly of claim 12 wherein the socket includes a passage therein connecting the recess and the engaging face, wherein lubricating fluid is adapted to flow through the lubricating passageway across the ball bearing through the axially extending slit and through the passage for lubricating the engaging face.

14. The rocker lever assembly of claim 10 wherein the spring urges the crosshead against the engaging face of the tappet socket which in turn seats the recess of tappet socket against the outer peripheral surface of the ball bearing, the tappet socket being freely disposed in the cage not contacting the cage for an operating range of movement of the rocker lever about the pivot axis.

15. The rocker lever assembly of claim 10 wherein the end segments define opposing recessed edges providing a larger width separation, the tappet socket adapted to snap into and out of the retainer through the larger width separation.

16. The rocker lever assembly of claim 10 wherein the first lever arm defines a second bore concentric with said bore having a diameter that is smaller than said bore, the bores being connected by a radially extending seating surface, the edge of the side wall being seated on the seating surface.

17. A tappet assembly for a lever assembly, the lever assembly including an arm with an opening pivotable about a pivot axis, the opening having an inner surface, the tappet assembly comprising:

a retainer having an outer side wall and a cage, the outer side wall adapted to be slidably received in the opening;

a ball bearing sized to be received within the outer side wall, adapted to exert radial outward force on the outer side wall for press fitting the retainer in the opening, the diameter of the ball bearing combined with the thickness of the side wall being greater than the diameter of the inner surface; and a tappet socket having a concave recess for receiving the ball bearing and an engaging face, the tappet socket being sized to be manipulated into the cage and retained therein for assembly.

18. The lever assembly of claim 17 wherein the side wall defines an axially extending slit.

19. The lever assembly of claim 17 wherein the tappet socket includes a passage connecting the concave recess and the engaging face for fluid communication therebetween.

20. The rocker lever assembly of claim 17 wherein the cage comprises a plurality of legs extending radially outward, the legs having end segments extending radially inward for catching the tappet socket.

21. A method of assembling a rocker lever assembly, comprising:

providing a rocker lever, a retainer, a ball bearing, and a tappet socket, the rocker lever including a lever arm pivotable about a pivot axis, the lever arm defining cylindrical opening, the retainer including a side wall and a cage, the tappet socket including a spherical recess and a engaging face;

inserting the retainer into the cylindrical opening with the sidewall being closely received therein;

press fitting the ball bearing into the inserted retainer to secure the side wall in the opening; and manipulating the tappet socket into the cage for retention thereby with the recess aligned to receive the ball bearing.

22. The method of claim 21 further comprising providing a valve assembly including a crosshead and a spring, and installing the valve assembly with the rocker lever assembly with the spring urging the crosshead against the engaging face of the tappet socket wherein the tappet socket is freely disposed in the cage not contacting the cage for an operating range of movement of the rocker lever about the pivot axis.

23. The method of claim 21 wherein the ball bearing is press fit into the inserted retainer at a force that is at least approximately one and half times larger than a maximum design load, the maximum design load being determined by the force that is anticipated to be applied to the ball bearing during operation.

24. The method of claim 21 wherein the cage comprises a pair resilient legs, the step of manipulating comprising snapping the socket in between the resilient legs.

25. The method of claim 21 wherein the sidewall includes an axial slit providing resilient flexibility to the side wall facilitating easier insertion of the retainer.

* * * * *